US010146239B2

(12) United States Patent
Deng

(10) Patent No.: US 10,146,239 B2
(45) Date of Patent: Dec. 4, 2018

(54) VOLTAGE REGULATOR WITH NOISE CANCELLATION FUNCTION

(71) Applicant: REALTEK SEMICONDUCTOR CORP., Hsinchu (TW)

(72) Inventor: Ping-Yuan Deng, Taoyuan (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 15/679,226

(22) Filed: Aug. 17, 2017

(65) Prior Publication Data

US 2018/0059696 A1 Mar. 1, 2018

(30) Foreign Application Priority Data

Aug. 26, 2016 (TW) ..... 105127443 A

(51) Int. Cl.

| | |
|---|---|
| ***G05F 1/46*** | (2006.01) |
| ***G05F 1/563*** | (2006.01) |
| ***G05F 1/565*** | (2006.01) |
| ***G05F 1/575*** | (2006.01) |

(52) U.S. Cl.

CPC ..... *G05F 1/467* (2013.01); *G05F 1/563* (2013.01); *G05F 1/565* (2013.01); *G05F 1/575* (2013.01)

(58) Field of Classification Search

CPC ..... G05F 1/467; G05F 1/575

See application file for complete search history.

(56) References Cited

U.S. PATENT DOCUMENTS

| | | | | |
|---|---|---|---|---|
| 7,397,226 | B1 | 7/2008 | Mannama et al. | |
| 7,405,546 | B2 | 7/2008 | Amrani et al. | |
| 7,919,954 | B1 | 4/2011 | Mannama et al. | |
| 2008/0169795 | A1 | 7/2008 | Wang et al. | |
| 2013/0027011 | A1* | 1/2013 | Shih | G05F 1/575 323/282 |
| 2014/0176098 | A1 | 6/2014 | Fang et al. | |
| 2017/0194855 | A1* | 7/2017 | Petenyi | G05F 1/625 |

FOREIGN PATENT DOCUMENTS

| | | |
|---|---|---|
| CN | 203745942 U | 7/2014 |
| CN | 104391533 A | 3/2015 |

* cited by examiner

*Primary Examiner* — Harry Behm

(74) *Attorney, Agent, or Firm* — Li & Cai Intellectual Property (USA) Office

(57) ABSTRACT

Disclosed is a voltage regulator. The voltage regulator includes a reference voltage circuit, a noise cancellation circuit, an error amplifier, a pass transistor and a voltage divider. The voltage regulator can cancel the noise generated by the reference voltage circuit and the error amplifier, and also can improve its Power Supply Rejection Ratio (PSRR).

7 Claims, 5 Drawing Sheets

VOLTAGE REGULATOR WITH NOISE CANCELLATION FUNCTION

BACKGROUND OF THE INVENTION

1. Field of the Invention

The instant disclosure relates to a voltage regulator; in particular, to a voltage regulator that can cancel noises caused by its own circuit elements.

2. Description of Related Art

The traditional voltage regulator comprises a reference voltage circuit, a low-pass filter, an error amplifier, a pass transistor, a voltage divider and the like. The above circuit elements may generate noises. In a traditional voltage regulator, noises mainly come from the reference voltage circuit, the error amplifier and the input voltage. The noise coming from the reference voltage circuit can be canceled by using the low-pass filter. However, the capacitor in the low-pass filter occupies a large area in a chip. The noise coming from the error amplifier can be filtered by the turned-on pass transistor and the load capacitor. However, a large load capacitance weakens the stability of the traditional voltage regulator. Also, the low-frequency noise cannot be perfectly filtered by the turned-on pass transistor and the load capacitor. The suppression of the noise from the input voltage to the output voltage can be represented by the power supply rejection ratio (PSRR). The noise from the input voltage to the output voltage can be reduced by using the error amplifier to compare a reference voltage and a dividing voltage of an output voltage. However, the noise reduction is restricted by the gain and the bandwidth of the error amplifier. Thus, how to more effectively reduce noise of a voltage regulator is still worth discussing.

SUMMARY OF THE INVENTION

The instant disclosure provides a voltage regulator with noise cancellation function. The voltage regulator can effectively reduce the noise caused by circuit elements of the voltage regulator itself.

The voltage regulator provided by the instant disclosure comprises a reference voltage circuit, a noise cancellation circuit, an error amplifier, a pass transistor and a voltage divider. An output end of the noise cancellation circuit is connected to the reference voltage circuit. The first input end of the error amplifier is connected to the reference voltage circuit, and the second input end of the error amplifier is connected to an input end of the noise cancellation circuit. Gate of the pass transistor is connected to an output end of the error amplifier, an input end of the pass transistor is connected to an input voltage, and an output end of the pass transistor is connected to an output voltage. The input end of the voltage divider is connected to the output end of the pass transistor, grounding end of the voltage divider is connected to a grounding end, and a voltage dividing end of the voltage divider is connected to the input end of the noise cancellation circuit. The output voltage comprises a first noise. The voltage dividing end of the voltage divider generates β times of the first noise. The noise cancellation circuit outputs a feedback noise to the first input end of the error amplifier according to β times of the first noise. The error amplifier, the pass transistor and the voltage divider forms a closed-loop amplifier. The closed-loop amplifier amplifies the feedback noise by 1/β times and outputs an adjusting noise to the output end of the pass transistor, such that the first noise is reduced by adding the adjust noise to the first noise.

To sum up, the voltage regulator provided by the instant disclosure can cancel noise caused by itself and the power supply noise. The noise caused by the voltage regulator itself and the power supply noise are transmitted to the noise cancellation circuit and then inverting noise is generated to cancel the noise caused by the voltage regulator itself and the power supply noise.

For further understanding of the instant disclosure, reference is made to the following detailed description illustrating the embodiments of the instant disclosure. The description is only for illustrating the instant disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

It will be understood that, although the terms first, second, third, and the like, may be used herein to describe various elements, these elements should not be limited by these terms. These terms are only to distinguish one element, region or section from another. For example, a first element, region or section could be termed a second element, region or section and, similarly, a second element, region or section could be termed a first element, region or section without departing from the teachings of the instant disclosure. As used herein, the term "and/or" includes any and all combinations of one or more of the associated listed items.

Figure 1:
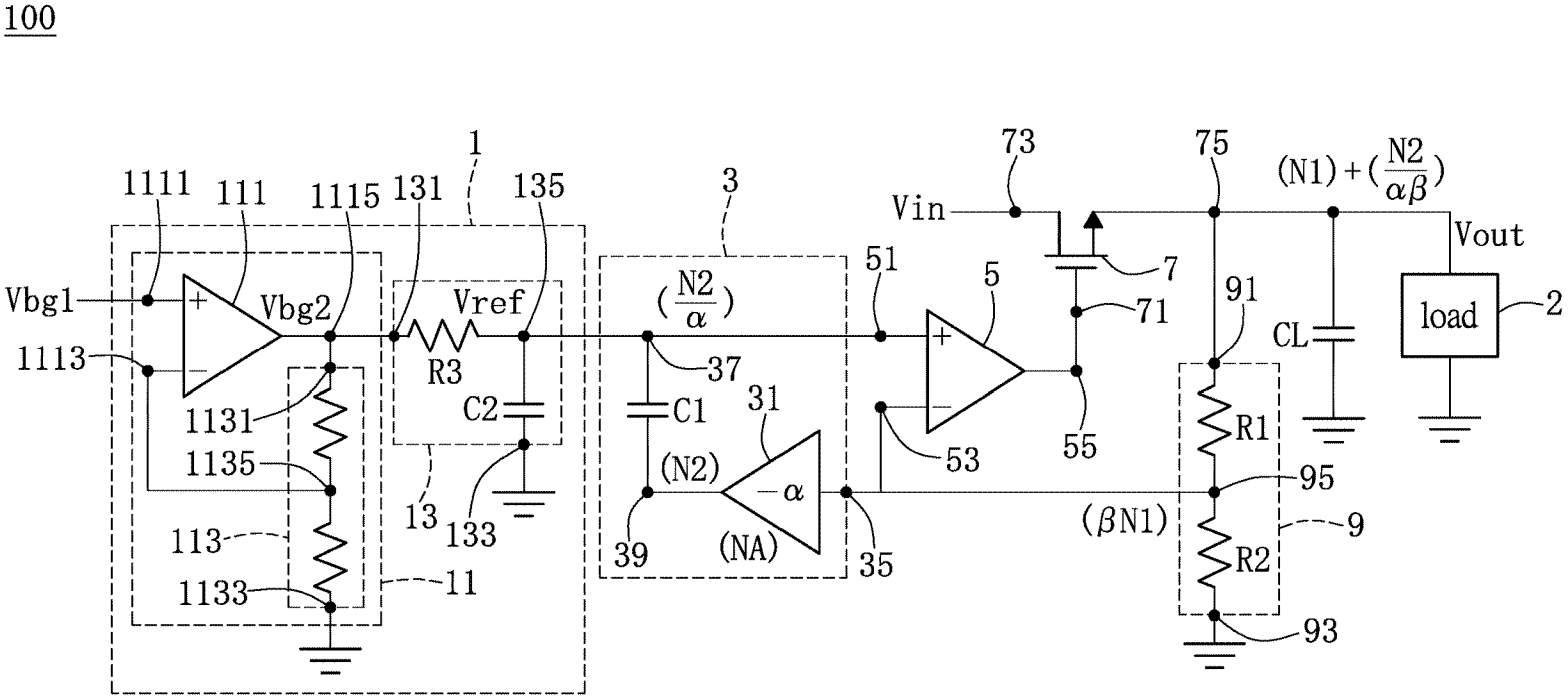
FIG. 1 shows a block diagram of a voltage regulator with noise cancellation function of one embodiment of the instant disclosure.

FIG. 1 shows a block diagram of a voltage regulator with noise cancellation function of one embodiment of the instant disclosure. The following embodiments of the voltage regulator 100 are for illustrating but not for restricting the instant disclosure. When the voltage regulator 100 is connected to a load 2 and thus generates a load capacitance CL, the voltage regulator 100 provided by the instant disclosure can effectively cancel the noise that a traditional voltage regulator would have. Also, the voltage regulator 100 provided by the instant disclosure can suppress the noise generated by the elements of the voltage regulator. The voltage regulator 100 provided by the instant disclosure can be used in any kind of power supply system, such as a frequency synthesizer, to provide a stable voltage.

As shown in FIG. 1, the voltage regulator 100 with the noise cancellation function comprises a reference voltage circuit 1, a noise cancellation circuit 3, an error amplifier 5, a pass transistor 7 and a voltage divider 9. The skilled in the art should easily understand that, the voltage regulator 100 can comprise less or more elements than the elements shown in FIG. 1.

In this embodiment, the reference voltage circuit 1 comprises a bandgap reference circuit 11 and a low-pass filter 13. The reference voltage circuit 1 is configured to a reference voltage Vref of the voltage regulator 100. The bandgap reference circuit 11 comprises an amplifier 111 and a voltage divider 113. The first input end 1111 of the amplifier 111 receives a bandgap voltage Bbg1, and the output end 1115 of the amplifier 111 outputs an output bandgap voltage Vbg2. The input end 1131 of the voltage divider 113 is connected to the output end 1115 of the amplifier 111. The grounding end 1133 of the voltage divider 113 is grounded. The voltage dividing end 1135 of the voltage divider 113 is connected to the second input end 1113 of the amplifier 111. The input end 131 of the low-pass filter 13 (which is one end of a resistor R3) is connected to the output end 1115 of the bandgap reference circuit 11 to receive the output bandgap voltage Vbg2. The grounding end 133 of the low-pass filter 13 (which is the second end of a capacitor C2) is grounded. The output end 135 of the low-pass filter 13 (which is the second end of the resistor R3 and the first end of the capacitor C2) outputs the reference voltage Vref. Those skilled in the art can design the elements and devices in the reference voltage circuit 1 depending on need. In other words, those skilled in the art can use elements and devices functioning like the amplifier 111, the voltage divider 113, and the low-pass filter 13 to design the reference voltage circuit 1. The elements and devices functioning like the voltage divider 113 may comprise a plurality of resistive elements and devices to do voltage division.

The noise cancellation circuit 3 comprises an inverting amplifier 31 and a first capacitor C1. The input end 35 of the noise cancellation circuit 3 is the input end of the inverting amplifier 31, the output end 39 of the inverting amplifier 31 is the first end of the first capacitor C1, and the second end of the first capacitor C1 is the output end 37 of the noise cancellation circuit 3.

However, in this embodiment, those skilled in the art can design the noise cancellation circuit 3 by adding or removing elements depending on need. For example, the inverting amplifier 31 can be a FET amplifier, a BJT amplifier, an operation amplifier or any element that can function as the inverting amplifier 31. As another example, the noise cancellation circuit 3 could merely comprise an inverting amplifier 31.

The output end 37 of the noise cancellation circuit 3 is connected to the output end 135 of the reference voltage circuit 1. The first input end 51 of the error amplifier 5 is connected to the output end 135 of the reference voltage circuit 1. The second input end 53 of the error amplifier 5 is connected to the input end 35 of the noise cancellation circuit 3. Gate 71 of the pass transistor 7 is connected to an input voltage Vin. The output end 75 of the pass transistor 7 outputs an output voltage Vout. The input end 91 of the voltage divider 9 is connected to the output end 75 of the pass transistor 7. The grounding end 93 of the voltage divider 9 is grounded. The voltage dividing end 95 of the voltage divider 9 is connected to the input end 35 of the noise cancellation circuit 3. Those skilled in the art can design the elements and devices in the voltage regulator 100 depending on need. In other words, those skilled in the art can use elements and devices functioning like the voltage divider 9 to design the voltage regulator 100, wherein the voltage divider 9 may comprise a plurality of resistive elements and devices to do voltage division. When the error amplifier 5 is a non-inverting amplifier, the pass transistor 7 is a NMOS transistor, but when the error amplifier 5 is an inverting amplifier, the pass transistor 7 is a PMOS transistor.

The output voltage Vout comprises a first noise N1. The first noise N1 comes from the input voltage Vin and/or the reference voltage circuit 1 and/or the error amplifier 5. The voltage dividing end 95 of the voltage divider 9 generates $\beta$ times of the first noise N1 according to the first noise N1, which equals to $\beta$N1. The input end 35 of the noise cancellation circuit receives the noise $\beta$N1, and uses the inverting amplifier 31 to amplify the noise $\beta$N1 by $-\alpha$ times. Noise NA can be caused by the noise cancellation circuit 3 itself, so the output end 39 of the inverting amplifier 31 generates a second noise N2 which is equal to $-\alpha\beta$N1+NA. The output end 37 of the noise cancellation circuit 3 outputs a feedback noise which is equal to N2/$\alpha$. $\alpha$ is related to the capacitance of the first capacitor C1 and the capacitance of the second capacitor C2. In other words, $\alpha$ can be determined by designing the capacitance of the first capacitor C1 and the second capacitor C2, and relevant details are illustrated later.

The first input end 51 of the error amplifier 5 receives the feedback noise which is equal to N2/$\alpha$. The error amplifier 5, the pass transistor 7 and the voltage divider 9 form a closed-loop amplifier of which the amplification factor is designed as 1/$\beta$. Thus, the output end 75 of the pass transistor 7 outputs an adjusting noise which is equal to N2/$\alpha\beta$.

Finally, at the output end 75 of the pass transistor 7, the adjust noise (which is equal to N2/$\alpha\beta$ is added to the first noise N1 to reduce the first noise N1.

$\beta$ is the ratio of the first resistor R1 to the second resistor R2 of the voltage divider 9, for example, $\beta$=R2/(R1+R2). If $\beta$=R2/(R1+R2), $\beta$ can be smaller than 1 or equal to 1 (that is, if $\beta$=1, R1=0.) The amplification factor of the closed-loop amplifier formed by the error amplifier 5, the pass transistor 7 and the voltage divider 9 can be designed as 1/$\beta$. In this case, when $\beta$ is designed as 1, the output end 75 of the pass transistor 7 is directly connected to the input end 35 of the noise cancellation circuit 3.

Those skilled in the art can determine $\beta$ by designing the ratio of the first resistor R1 to the second resistor R2 to obtain the amplification factor of the error amplifier 5. However, the amplification factor of the error amplifier 5 can be related to $\beta$ or cannot be related to $\beta$, and it is not limited herein.

$\alpha$ can be determined be designing the capacitance of the first capacitor C1 in the noise cancellation circuit 3 and the capacitance of the second capacitor C2 in the low-pass filter 13. For example, $\alpha$=(C1+C2)/C1. If $\alpha$=(C1+C2)/C1, $\alpha$ can be larger than 1, smaller than 1 (that is, there is no first capacitor C1) or equal to 1 (that is, the capacitance of the second capacitor C2 is 0). The amplification factor of the inverting amplifier 31 is designed as $-\alpha$.

Those skilled in the art can design the noise cancellation circuit 3 depending on need by adding or removing elements or changing the circuit design of the noise cancellation circuit 3. For example, the noise cancellation circuit 2 could only have an inverting amplifier 31. For another example, $\alpha$ can be obtained according to the ratio of the capacitance of the first capacitor C1 in the noise cancellation circuit 3 to the capacitance of the second capacitor C2 of the low-pass filter 13 in the reference voltage circuit 1. After that, the amplification factor of the inverting amplifier 31 can be obtained as $-\alpha$. For other examples, the amplification factor of the inverting amplifier 31 could be N times of $\alpha$ or not related to $\alpha$.

Figure 2:
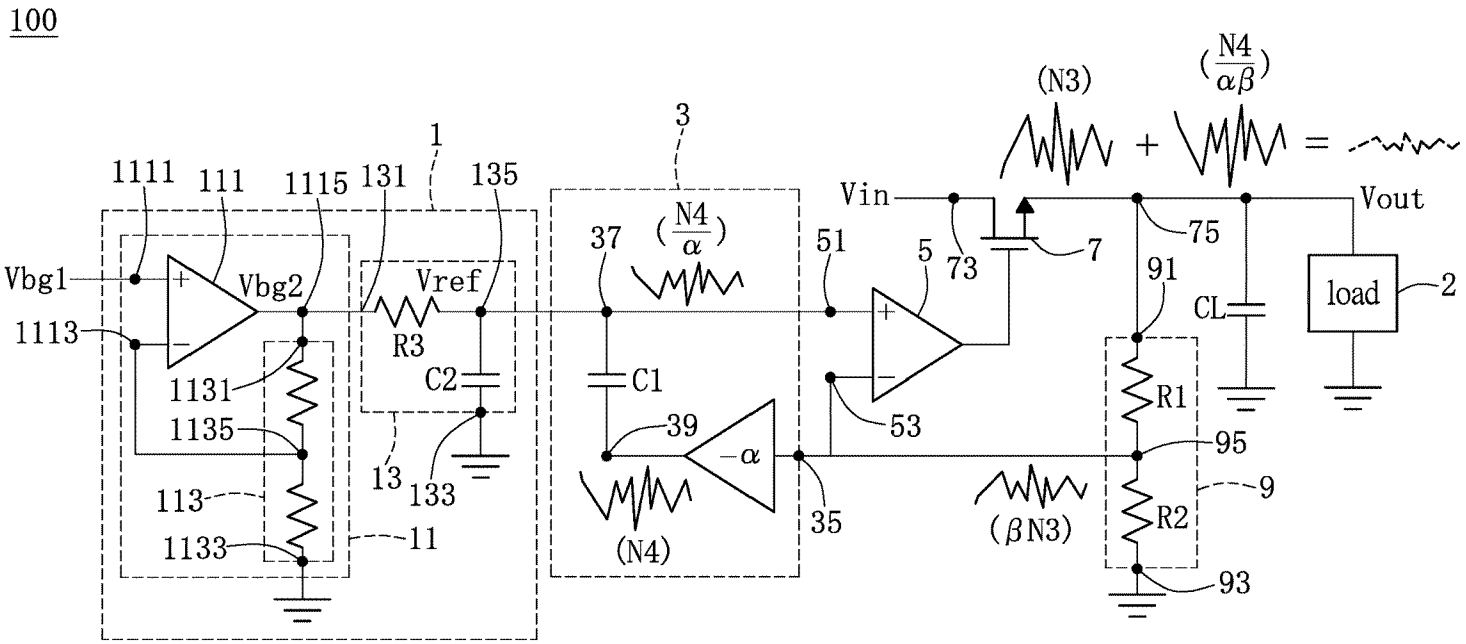
FIG. 2 is a schematic diagram showing how to cancel noise generated by the bandgap reference circuit and the error amplifier.

FIG. 2 is a schematic diagram showing how to cancel noise generated by the bandgap reference circuit and the error amplifier.

In this embodiment, the output end 75 of the pass transistor outputs an output voltage Vout. The output voltage Vout comprises a third noise N3, and the third noise N3 comes from the reference voltage circuit 1 and the reference voltage circuit 5. The voltage dividing end 95 of the voltage divider 9 generates $\beta$ times of the third noise N3 (that is, $\beta$N3) according to the third noise N3 in the output voltage Vout.

The input end 35 of the noise cancellation circuit 3 receives the noise which is equal to $\beta$N3. The noise cancellation circuit 3 also generates the noise NA, so the output end 39 of the inverting amplifier 31 will output a fourth noise N4 which is equal to $-\alpha\beta$N3+NA. After that, by designing the capacitance of the first capacitor C1 and the second capacitor C2, the fourth noise N4 is amplified by $1/\alpha$ times. That is, the feedback noise outputted from the output end of the noise cancellation circuit 3 will be equal to N4/$\alpha$. Details relevant to designing $\alpha$ are described in the last embodiment, and thus the information is not repeated.

The first input end 51 of the error amplifier 5 receives the feedback noise which is equal to N4/$\alpha$. The error amplifier 5, the pass transistor 7 and the voltage divider 9 forms a closed-loop amplifier. The amplification factor of the error amplifier 5 is designed as $1/\beta$. Thus, the output end 75 of the pass transistor 7 will output an adjusting noise which is equal to N4/$\alpha\beta$.

Finally, at the output end 75 of the pass transistor 7, the adjust noise (which is equal to N4/$\alpha\beta$) is added to the third noise N3 to reduce the third noise N3.

Figure 3:
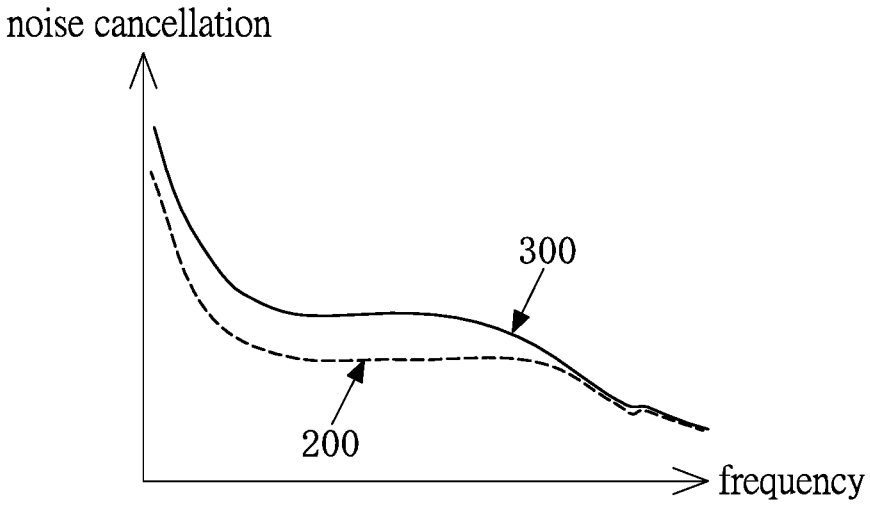
FIG. 3 is a schematic diagram showing noise cancellation results of the instant disclosure and a traditional voltage regulator, wherein the noise is generated by the bandgap reference circuit and the error amplifier.

FIG. 3 is a schematic diagram showing noise cancellation results of the instant disclosure and a traditional voltage regulator, wherein the noise is generated by the bandgap reference circuit and the error amplifier. As shown in FIG. 3, according to the noise curve 200 of the voltage regulator 100 provided by the instant disclosure and the noise curve 300 of a traditional voltage regulator, in most of working frequencies, the voltage regulator 100 provided by the instant disclosure has a better noise cancellation result. The inverting amplifier 31 of the noise cancellation circuit also generates a noise, but it is much smaller than the noise generated by the reference voltage circuit 1 and the error amplifier 5. Thus, the voltage regulator 100 provided by the instant disclosure at least has advantages as follows: 1) the capacitance of the first capacitor C1 does not need to be large to process the low-frequency noise, because by using the capacitive voltage divider formed by the first capacitor C1 in the noise cancellation circuit 3 and the second capacitor C2 in the low-pass filter 13 the noise forms a dividing voltage; 2) the amplification factor of the inverting amplifier 31 in the noise cancellation circuit 3 is equal to $-\alpha$, which is the reciprocal of the capacitive dividing voltage related to the capacitance of the first capacitor C1 and the second capacitor C2; and 3) there is no additional noise filter, addition circuit/subtraction circuit, or comparison circuit needed, and thus the circuit complexity can be dramatically decreased.

Figure 4:
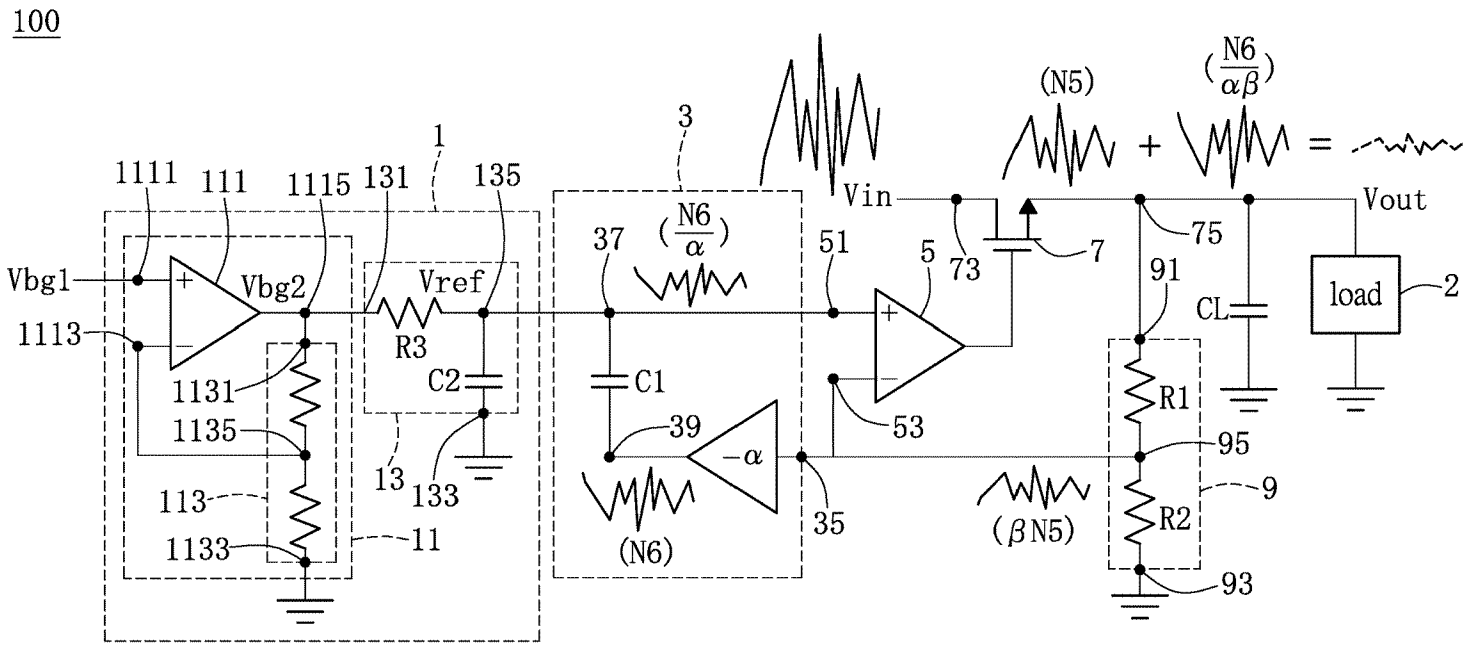
FIG. 4 is a schematic diagram showing how to cancel noise for improving the power supply rejection ratio.

FIG. 4 is a schematic diagram showing how to cancel noise for improving the power supply rejection ratio (PSRR). As shown in FIG. 4, the noise coming from the input voltage Vin can be suppressed by the closed-loop amplifier formed by the error amplifier 5, the pass transistor 7 and the voltage divider according to the PSRR. When the noise coming from the input voltage Vin is suppressed according to the PSRR, the voltage regulator 100 will output a fifth noise N5.

The noise cancellation circuit 3 can cancel the fifth noise N5. In one embodiment, the output end 75 of the pass transistor 7 outputs an output voltage Vout, and the output voltage Vout comprises a fifth noise N5. The voltage dividing end 95 of the voltage divider 9 generates $\beta$ times of the fifth noise N5 according to the fifth noise N5 in the output voltage Vout, which is equal to $\beta$N5.

The input end 35 of the noise cancellation circuit receives the noise which is equal to $\beta$N5. The noise cancellation circuit 3 also generates a noise NA, so the output end 39 of the inverting amplifier 31 will output a sixth noise N6 which is equal to $-\alpha\beta$N5+NA. After that, by designing the capacitance of the first capacitor C1 and the second capacitor C2, the sixth noise N6 is amplified by $1/\alpha$ times. That is, the feedback noise outputted from the output end of the noise cancellation circuit 3 is equal to N6/$\alpha$, wherein details relevant to designing $\alpha$ are described in the last embodiment and thus the information is not repeated.

The first input end 51 of the error amplifier 5 receives the feedback noise which is equal to N6/$\alpha$. The error amplifier 5, the pass transistor 7 and the voltage divider 9 form a closed-loop amplifier. The amplification factor of the error amplifier 5 is designed as $1/\beta$, and thus the output end 75 of the pass transistor will output an adjusting noise which is equal to N6/$\alpha\beta$.

Finally, at the output end 75 of the pass transistor 7, the adjust noise (which is equal to N6/$\alpha\beta$) is added to the fifth noise N5 to reduce the fifth noise N5.

Figure 5:
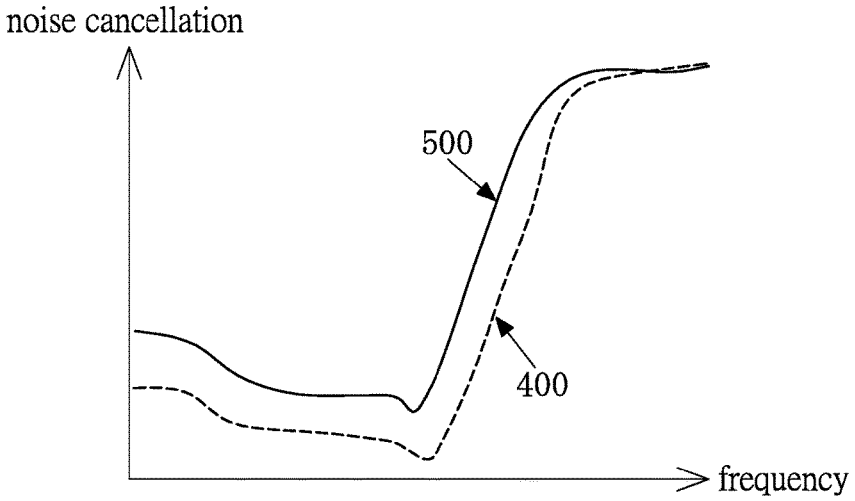
FIG. 5 is a schematic diagram showing noise cancellation according to the power supply rejection ratio of the instant disclosure and a traditional voltage regulator.

FIG. 5 is a schematic diagram showing noise cancellation results, according to the power supply rejection ratio, of the voltage provided by the instant disclosure and a traditional voltage regulator. As shown in FIG. 5, according to the noise curve 400 of the voltage regulator 100 provided by the instant disclosure and the noise curve 500 of a traditional voltage regulator, in most working frequencies, the voltage regulator 100 provided by the instant disclosure has a better noise cancellation result. In addition to a negative feedback path formed by the error amplifier 5, the pass transistor 7 and the voltage divider 9, another path is formed from the voltage dividing end 95 of the voltage divider 9 to the output end 37 of the noise cancellation circuit. These two paths can simultaneously help to improve the power supply rejection ratio. Thus, one of the advantages of the instant disclosure is to improve the power supply rejection ratio of the voltage regulator.

To sum up, in the voltage regulator provided by the instant disclosure, the noise in the input voltage can be suppressed according to the power supply rejection ratio. In addition, the noise cancellation circuit in the voltage regulator can suppress the noise generated by the voltage regulator itself and the noise generated by elements in the voltage regulator, which can effectively improve the power supply rejection ratio.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A voltage regulator with noise cancellation function, comprising:

a reference voltage circuit;

a noise cancellation circuit, having an output end connected to the reference voltage circuit;

an error amplifier, having a first input end connected to the reference voltage circuit, having a second input end connected to an input end of the noise cancellation circuit;

a pass transistor, having a gate connected to an output end of the error amplifier, having an input end connected to an input voltage, and having an output end connected to an output voltage; and a voltage divider, having an input end connected to the output end of the pass transistor, having a grounding end connected to a grounding end, and having a voltage dividing end connected to the input end of the noise cancellation circuit;

wherein the output voltage comprises a first noise, the voltage dividing end of the voltage divider generates β times of the first noise, the noise cancellation circuit outputs a feedback noise to the first input end of the error amplifier according to β times of the first noise, and the error amplifier, the pass transistor and the voltage divider forms a closed-loop amplifier, the closed-loop amplifier amplifies the feedback noise by 1/β times and outputs an adjusting noise to the output end of the pass transistor, such that the first noise is reduced by adding the adjust noise to the first noise;

wherein the noise cancellation circuit comprises:

an inverting amplifier, having −α as an inverting amplification factor, and amplifying the β times of the first noise according to the inverting amplification factor to output a second noise; and a first capacitor, connected between the output end of the inverting amplifier and the first input end of the error amplifier, outputting the feedback noise according to the second noise;

wherein α is larger than 1, equal to 1 or smaller than 1;

wherein the voltage regulator further comprises:

a second capacitor, connected between the first input end of the error amplifier and the grounding end;

wherein α is related to the capacitance of the first capacitor and the capacitance of the second capacitor.

2. The voltage regulator according to claim 1, further comprising:

a resistor, connected between the second capacitor and a bandgap reference circuit of the reference voltage circuit;

wherein the resistor and the second capacitor forms a low-pass filter.

3. The voltage regulator according to claim 1, wherein the inverting amplifier is a FET amplifier, a BJT amplifier or an operation amplifier.

4. The voltage regulator according to claim 1, wherein β is smaller than or equal to 1.

5. The voltage regulator according to claim 4, wherein when β is equal to 1, the output end of the pass transistor connected to the input end of the voltage divider and the voltage dividing end of the voltage divider connected to the input end of the noise cancellation circuit are equal to the output end of the pass transistor connected to the input end of the noise cancellation circuit.

6. The voltage regulator according to claim 1, wherein when the error amplifier is a non-inverting amplifier, and the pass transistor is a NMOS transistor.

7. The voltage regulator according to claim 1, wherein the first noise comes from the input voltage and/or the reference voltage circuit and/or the error amplifier.

* * * * *